United States Patent [19]

Born

[11] 4,347,002

[45] Aug. 31, 1982

[54] METHOD AND APPARATUS FOR THE PREPARATION OF DRILLING MUD

[76] Inventor: Raisa I. Born, kvartal 24, 53, kv. 89, Tashkent, Chilanzar, U.S.S.R.

[21] Appl. No.: 205,441

[22] PCT Filed: Sep. 28, 1979

[86] PCT No.: PCT/SU79/00090

§ 371 Date: Sep. 16, 1980

§ 102(e) Date: Sep. 11, 1980

[87] PCT Pub. No.: WO80/01495

PCT Pub. Date: Jul. 24, 1980

[30] Foreign Application Priority Data

Jan. 16, 1979 [SU] U.S.S.R. ..... 2705502

[51] Int. Cl.[3] ..... B28C 5/46; B01F 15/02; B01F 11/00

[52] U.S. Cl. ..... 366/6; 366/176; 366/332; 366/334; 366/341

[58] Field of Search ..... 366/6, 2, 3, 5, 10, 366/11, 51, 64, 332, 333, 334, 176, 140, 341

[56] References Cited

U.S. PATENT DOCUMENTS

| | | | |
|---|---|---|---|
| 1,680,678 | 8/1928 | Halliburton | 366/3 |
| 2,103,549 | 12/1937 | O'Neil | 366/176 |

FOREIGN PATENT DOCUMENTS

| | | | |
|---|---|---|---|
| 621923 | 2/1927 | France | 366/2 |
| 865127 | 4/1961 | United Kingdom | 366/176 |
| 619500 | 7/1978 | U.S.S.R. . | |
| 626192 | 8/1978 | U.S.S.R. . | |

*Primary Examiner*—Edward J. McCarthy
*Attorney, Agent, or Firm*—Steinberg & Raskin

[57] ABSTRACT

A method for the preparation of drilling mud wherein solid and liquid phases of drilling mud are mixed in a vessel (2) to obtain a homogeneous suspension. After the mixing the drilling mud is caused to pass under pressure through apertures (5 or 6) provided in a stirring member (3 or 4) of a piston type, the apertures being of a diameter which is greater than maximum size of an individual solid phase particle but smaller than the diameter of aggregates of particles, to prepare dispersed drilling mud.

15 Claims, 2 Drawing Figures

METHOD AND APPARATUS FOR THE PREPARATION OF DRILLING MUD

TECHNICAL FIELD

The present invention relates to the well drilling art and, more particularly, to methods and apparatus for the preparation of drilling mud.

The present invention may be most advantageously used in the oil and gas production for the preparation of drilling mud.

BACKGROUND OF THE INVENTION

At present drilling mud is prepared by mixing clay powder with water either in mechanical mixers, jet-cutting mills and hydrojet mixers exhibiting a sufficient stirring capacity but low performance and efficiency of dispersing action, or in magnetostriction apparatus which exhibit high performance but also have a low efficiency of dispersion of solid phase "Driller's Handbook" by V. I. Mischevich, N. A. Sidorov, vol. 1, published 1973, Nedra Publishers, Moscow, pp. 359–367 (in Russian).

Dispersion of solid phase of drilling mud is an important production step in the preparation of drilling mud since it substantially improves quality of the drilling mud and reduces the consumption of clay powder, weighing compound and chemicals.

Known in the art are various apparatus for the preparation of drilling mud by dispersing solid phase, such as bead mills, comprising a milling chamber accommodating a shaft, plates and milling bodies. These apparatus are, however, rather unproductive, they are inconvenient in operation and exhibit rapid wear of milling bodies (USSR Inventor's Certificates Nos. 447.497, 447.498 published in Bull. "Discoveries, Inventions, Industrial Designs and Trademarks", No. 39, 1974, IPC, E21B, 11/00).

Known in the art is an apparatus for the preparation of drilling mud, comprising a closed vessel having inlet and outlet pipes and accommodating a piston which is arranged between perforated plates (USSR Inventor's Certificate No. 438.433, published in Bull. "Discoveries, Inventions, Industrial Designs and Trademarks", No. 29, 1975, IPC B01F, 11/00).

Drilling mud is prepared in this apparatus by stirring the components during the piston movement. A dispersing action is not, however, ensured in this apparatus since the intensity of destruction of compacted aggregates of solid phase is low due to a constant pressure of materials being mixed. In addition, the apparatus required the use of a special pump thus increasing power requirements and cost.

The main object of the present invention is to provide a method and an apparatus for preparation of drilling mud which owing to an efficient dispersing action ensure the intensity of physico-chemical exchange process while substantial lowering power requirements and cost.

The invention resides in that in a method for the preparation of drilling mud, comprising mixing solid and liquid phases of drilling mud to obtain a homogeneous suspension, according to the invention, drilling mud is caused to pass under pressure, after the mixing, through apertures of a diameter which is greater than maximum size of an individual solid phase particle but smaller than the diameter of aggregates of such particles, to prepare dispersed drilling mud.

The method according to the invention enables an improvement of intensity of dispersing action owing to the throttling of a mixture which results in a commminution of solid phase particles due to turbulization and cavitation occurring when the flow of drilling mud passes through the apertures.

pH of the drilling mud is preferably caused to grow simultaneously with the passage of the drilling mud through the apertures. An increase in pH (that is alkalinity) of drilling mud improves the conditions for dispersing solid phase.

pH of drilling mud is preferably caused to grow by means of a unipolar electric treatment of drilling mud thus eliminating the influence of noxious oxidation products in the zone of negative electrode, improving the intensity of physico-chemical exchange processes and contributing to an improvement of the efficiency of dispersing action.

The method disclosed in the present invention is preferably carried out in an apparatus comprising a vessel for stirring solid and liquid phases of drilling mud, having inlet and outlet openings and a stirring member accommodated in the vessel and connected to a drive by means of a rod, wherein, according to the invention, the stirring member comprises at least one piston with calibrated apertures of a diameter which is greater than maximum size of an individual solid phase particle but smaller than the diameter of aggregates of such particles.

This arrangement of the apparatus enables an improvement of the intensity of dispersing action on solid phase and reduction of cost of the preparation of drilling mud since the stirring member also functions as a pump.

The apparatus is preferably provided with at least one additional pistion which is mounted in the vessel for movement in opposition to the first piston. This arrangement enables an increase in impact and abrading forces applied to solid phase and also an increase in the pressure difference in the medium being dispersed.

The additional piston is preferably made also with calibrated apertures of a diameter which is greater than maximum size of an individual solid phase particle but smaller than the diameter of aggregates of such particles so that individual particles can pass through the apertures and aggregates are comminuted into finer parts upon collision of the pistons.

The apertures of one piston are preferably misaligned with respect to the apertures of the additional piston so as to intensify the turbulization of drilling mud flow by bending it.

Total area of the calibrated apertures of each piston is preferably equal to or smaller than the surface area of the remaining part of the piston between the apertures.

This arrangement of the pistons enables the creation of pressure difference in the spaces between and behind the pistons during their relative movement thus intensifying turbulization of liquid jets passing the apertures.

The apparatus is preferably provided with one positive electrode and another negative electrode which are separated by means of a semipermeable partition defining two chambers of which one chamber accommodating the negative electrode is designed for the preparation of finished drilling mud and the other chamber is designed for accumulating products of oxidation reactions which are formed upon passing electric current through drilling mud. A direct current source is provided which has the negative terminal connected to at least one piston and the positive terminal connected to a wall of the vessel through which extends the rod of this piston, at least one semipermeable partition being provided adjacent to this wall to define with the wall a chamber for accumulating products of oxidation reactions which are formed when electric current is passed through drilling mud the partition being made of a material hindering the penetration of products of oxidation reactions to the remaining part of the vessel.

This arrangement of the apparatus enables an increase in pH (alkalinity) of drilling mud during dispersion of solid phase in the chamber for the preparation of finished drilling mud, and the provision of chambers for accumulating products of oxidation reactions enables the prevention of the penetration of such products to the negative electrode zone where an electric treatment of drilling mud is effected.

Therefore, the method and apparatus according to the invention make it possible to prepare finely dispersed drilling mud, that is quality of drilling mud being produced is substantially improved, and both power requirements and cost are lowered.

BRIEF DESCRIPTION OF THE DRAWINGS

Specific embodiments of the invention will now be described with reference to the accompanying drawings, in which.

BEST MODE FOR CARRYING OUT THE INVENTION

Figure 1:
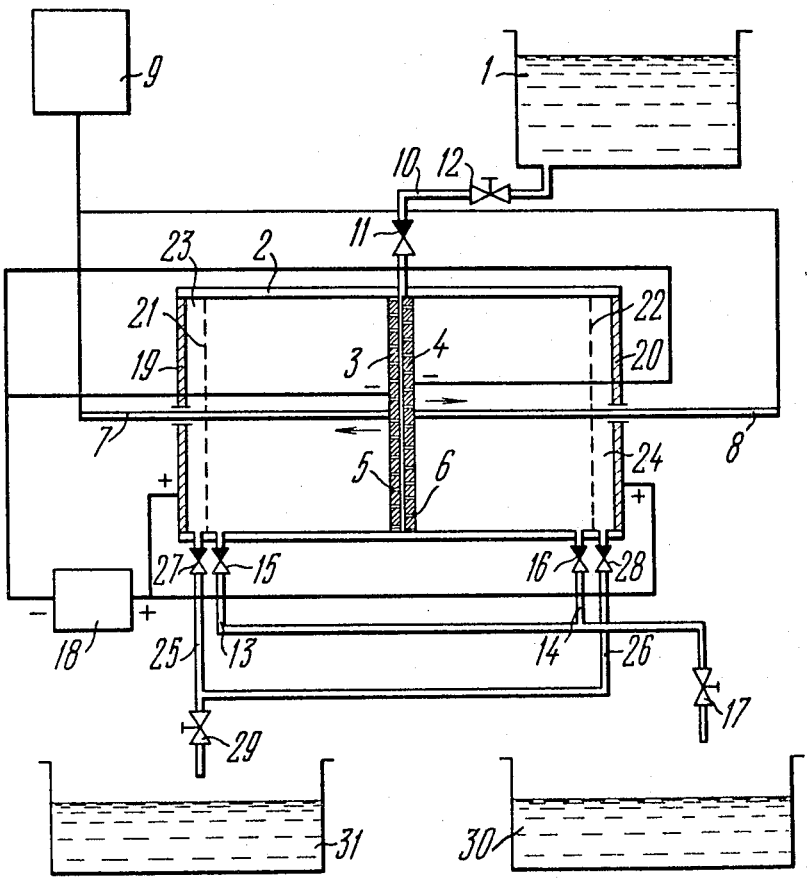
FIG. 1 schematically shows an apparatus for the preparation of drilling mud according to the invention, with the pistons moving away from the center to the ends of the vessel.
Figure 2:
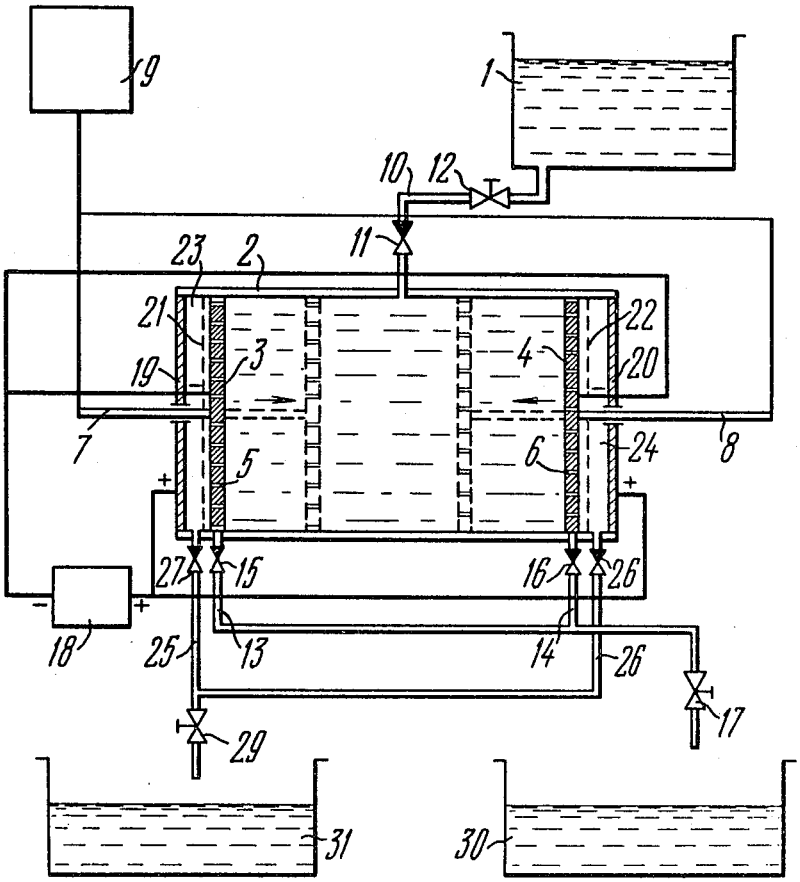
FIG. 2 schematically shows an apparatus according to the invention, with the pistons moving toward one another.

For a better understanding of the invention, reference is made to FIGS. 1 and 2.

A method according to the invention resides in that drilling mud is caused to pass under pressure, after mixing solid and liquid phases, through apertures of a diameter which is greater than maximum size of an individual solid phase particle but smaller than the diameter of aggregates of particles to prepare dispersed drilling mud. At the same time pH of drilling mud is caused to grow by means of a unipolar electric treatment.

Advantages of the method according to the invention will become apparent from the description of a specific embodiment of an apparatus for carrying out the method.

An apparatus for carrying out the method for the preparation of drilling mud (FIGS. 1 and 2) comprises a vessel 1 for a starting suspension and a dispersing vessel 2 accommodating a stirring member comprising pistons 3 and 4 having calibrated apertures 5 and 6. Diameters of the apertures 5 and 6 are greater than maximum size of an individual solid phase particle but smaller than the diameter of aggregates of such particles. The apertures 5 of the piston 3 are misaligned with respect to the apertures 6 of the piston 4. The pistons 3 and 4 are mounted in the vessel 2 for movement in opposition to one another and are connected to a drive 9 by means of rods 7 and 8.

The vessel 2 is communicated with the vessel 1 by means of a pipeline 10 having a check valve 11 and a valve 12 and has outlet pipes 13 and 14 with check valves 15 and 16, respectively, and a valve 17.

The apparatus for the preparation of drilling mud also has a direct current source 18 having the negative terminal connected to the pistons 3 and 4 and the positive terminal connected to end walls 19 and 20 of the vessel 1. Semipermeable partitions 21 and 22 are provided adjacent the walls 19 and 20 to define therewith chambers 23 and 24 for accumulating products of oxidation reactions. The chambers 23 and 24 are provided with drain pipes 25 and 26, respectively, having check valves 27 and 28 and a valve 29.

Finished drilling mud is fed to a tank 30 and products of oxidation reactions are removed to a tank 31.

The apparatus for carrying out the method for the preparation of drilling mud functions in the following manner.

The drive 9 is turned on for moving the pistons 3 and 4. The pistons 3 and 4 are abruptly caused to move, e.g. away from one another toward the end walls 19 and 20 of the vessel 2 (FIG. 1). A reduced pressure zone is thereby formed between the pistons 3 and 4 to which starting suspension is admitted by aspiration through the check valve 11 along the pipeline 10 from the vessel 1 (the valve 12 is open).

At next moment, when the pistons 3 and 4 are abruptly caused to move toward one another (FIG. 2), the drilling mud starts overflowing to the spaces behind the pistons. Dispersion thus occurs. Dispersion of solid phase is effected due to the action of the following factors. First, when the pistons 3 and 4 move toward one another, the drilling mud is throttled in the form of fine jets when it passes through the apertures 5 and 6. Increased pressure is created in the space between the pistons 3 and 4, and reduced pressure zones are formed in the spaces between the pistons 3 and 4 and the end walls 19 and 20. Therefore, a pressure difference in the jets of drilling mud passing through the apertures 5 and 6, which is due to the pressure growth between the pistons 3 and 4 and pressure drop behind the pistons, provides for turbulization of flow, which is further intensified owing to the misalignment of the apertures 5 of the piston 3 and apertures 6 of the piston 4. Second, when the drilling mud passes through the apertures the cross-section of the flow is materially reduced thus resulting in cavitation.

All above-described factors result in an intense stirring and comminution of solid phase particles.

The size of the apertures of the pistons 3 and 4 shall be greater than maximum size of solid particle so that no clogging of apertures can occur, but smaller than the size of an aggregate of sticking particles which should be crushed upon collision with the pistons 3 and 4 or mushed between the pistons.

Pressure at which drilling mud is compressed by the pistons 3 and 4 depends on the pistons speed, their surface area and volume of liquid being treated.

At the moment the pistons 3 and 4 approach one another the check valve 11 is closed so as to prevent drilling mud from getting from the vessel 2 to the pipeline 10, and the check valves 15, 16, 27 and 28 do not admit liquids from the tanks 30 and 31 to the vessel 2.

During the next cycle, when the pistons 3 and 4 start moving away toward the walls 19 and 20 drilling mud is partially forced out by the pistons 3 and 4 to the tank 30 through the check valves 15 and 16 and the valve 17. A fresh batch of untreated drilling mud is admitted from the vessel 1 by aspiration to the vessel 2 through the check valve 11 and valve 12.

In case it is necessary to make a repeated treatment of one and the same batch of drilling mud, the valves 12, 17 and 29 are closed, and drilling mud is dispersed by repeatedly passing through the apertures 5 and 6 from the increased pressure zone to the reduced pressure zone.

My studies conducted in testing various methods of physical (dispersing) action on solid phase of drilling mud showed that during comminution of solid clayey particles in liquid the efficiency of dispersing action decreases as the particles become finer. Decrease in the intensity of dispersing action with the dispersion time is due on the one hand to increased strength of finer particles (compared to coarser particles) and, on the other hand, as it has been found during the studies, to a change in the nature of dissociation of silanol groups which are formed as a result of interaction of the surface of clayey materials (alumosilicates) with water in accordance with a well known reaction:

$$2(-SiO)+H_2O \rightarrow 2(-SiOH).$$

A compound, polysilicic acid which is formed as a result of this reaction generally dissociated in water in accordance with an acid reaction type:

$$-SiOH \rightarrow SiO^- + H^+.$$

The resultant $H^+$ ions (actually $H_2O^+$) entry the liquid phase but, owing to the Coulomb interaction with ions $SiO^-$ they form an external layer in the drilling mud at the solid phase surface. An internal layer defines the negative sign of zeta potential.

As it can be seen from the chemical reaction occurring during the dispersion of clayey phase of drilling mud and interaction of clayey particles with water, there is one general ragularity: the greater the number of ions most strongly retaining water are (or can be adsorbed) on the planes of individual clayey particles, the lower pH of drilling mud and the stronger the decrease in the efficiency of subsequent comminution of clayey particles. Therefore, in order to provide for better conditions for dispersion of solid phase, it is necessary to provide for dissociation of silanol groups to occur preferably in accordance with the acid reaction type or, in other words, maximum increase in pH of drilling mud should be provided during dispersion of clayey minerals in water. In such case dissociation occurs in the reduction form and, it is necessary for this that dispersion medium should have an excess of negative charge.

As it has been found during the studies, unipolar treatment of drilling mud results in a material increase in reduction potential of drilling mud (increase in pH) in the zone of the negative electrode thus ensuring complete dissociation of groups in accordance with the acid reaction type.

Therefore, by connecting the positive terminal of the current source 18 to the end walls 19 and 20 which are made of an electrically conducting material, and the negative terminal to the pistons 3 and 4 which are also made of an electrically conducting material a d-c electric field is formed between the pistons 3 and 4 and the end walls 19 and 20 (the remaining part of the casing is made of an insulating material), the electric field causing a material increase in pH of drilling mud in the zone of the negative electrode which in this specific embodiment comprises the pistons 3 and 4, and products of oxidation reactions are formed in the zone of the positive electrode (in the chambers defined by the end walls 19 and 20 and the semipermeable partitions 21 and 22) and are removed during the movement of the pistons 3 and 4 toward the end walls 19 and 20 through the drain pipes 25 and 26 and the valve 29 to the tank 31. The provision of the semipermeable partitions 21 and 22 prevents products of oxidation reactions from getting to the zone of the negative electrodes 3 and 4.

Therefore, during dispersion of drilling mud unipolar electric treatment thereof occurs simultaneously in the field of the negative electrode so as to increase pH of drilling mud thus enabling a material improvement in the intensity of dispersing action without an increase in power requirements and only owing to a structural improvement of the apparatus.

An additional advantage of the apparatus resides in that it can function both as dispergator and pump.

The structural arrangement of the apparatus according to the invention makes it possible to have several pistons (more than two) which can be mounted e.g. in tandem. One piston may be rigidly fixed and the other pistons may be movable. One piston may be without apertures.

INDUSTRIAL APPLICABILITY

The apparatus is simple in the manufacture and its application enables the preparation of low-clayey drilling mud of high quality, consumption of clayey materials and chemicals is reduced and power requirements are lowered according to the present invention.

I claim:

1. A method for the preparation of drilling mud comprising mixing solid and liquid phases of drilling mud to obtain a homogenous suspension, characterized in that drilling mud is caused to pass under pressure after the mixing through apertures of a diameter which is greater than maximum size of an individual solid phase particle but smaller than the diameter of aggregates of particles, to prepare dispersed drilling mud, and wherein the pH of the drilling mud is caused to grow simultaneously with the passage of the drilling mud through the apertures by subjecting the drilling mud to a unipolar electric treatment.

2. An apparatus for carrying out the method claimed in claim 1, comprising a vessel for mixing solid and liquid phases of drilling mud having inlet and outlet pipes and a stirring member accommodated in the vessel and connected with a drive by means of a rod, characterized in that the stirring member comprises at least one piston having calibrated apertures of a diameter which is greater than maximum size of an individual solid phase particle but smaller than the diameter of aggregates of these particles.

3. An apparatus according to claim 2, characterized in that it is provided with at least one additional piston mounted in the vessel for movement in opposition to the first piston 3.

4. An apparatus according to claim 3, characterized in that the additional piston is also made with calibrated apertures of a diameter which is greater than maximum size of an individual solid phase particle but smaller than the diameter of aggregates of these particles.

5. An apparatus according to claim 4, characterized in that the apertures of one piston are misaligned with respect to the apertures of the additional piston.

6. An apparatus according to claim 5, characterized in that the total area of the calibrated apertures in each of the pistons is equal to or smaller than the surface area of the remaining part of the piston between the apertures.

7. An apparatus according to claims 2, 3, 4, 5 or 6 characterized in that the vessel accommodates one positive electrode and another negative electrode which are separated by means of a semipermeable partition dividing the vessel into two chambers of which one chamber accommodating the negative electrode is designed for the preparation of finished drilling mud and the other chamber is designed for accumulating products of oxidation reactions formed as a result of passage of electric current through drilling mud.

8. An apparatus according to, claims 2, 3, 4, 5 or 6, characterized in that there is provided a direct current source having its negative terminal connected to at least one piston and the positive terminal connected to a wall of the vessel through which extends the rod of this piston at least one semipermeable partition being provided adjacent to this wall to define with the wall a chamber for accumulating products of oxidation reactions formed upon passing electric current through drilling mud, the partition being made of a material hindering the penetration of products of oxidation reactions to the remaining part of the vessel.

9. An apparatus for carrying out the preparation of drilling mud comprising a vessel for mixing solid and liquid phases of drilling mud having inlet and outlet pipes and a stirring member accommodated in the vessel and connected with a drive by means of a rod, characterized in that the stirring member comprises at least one piston having calibrated apertures of a diameter which is greater than maximum size of an individual solid phase particle but smaller than the diameter of aggregates of these particles.

10. An apparatus according to claim 9, characterized in that it is provided with at least two pistons mounted in the vessel for movement in opposition to each other.

11. An apparatus according to claim 10, characterized in that each piston has calibrated apertures formed therein of a diameter which is greater than maximum size of an individual solid phase particle but smaller than the diameter of aggregates of these particles.

12. An apparatus according to claim 11, characterized in that the apertures of one piston are misaligned with respect to the apertures 6 of the other piston.

13. An apparatus according to claim 12, characterized in that the total area of the calibrated apertures in each of the pistons is equal to or smaller than the surface area of the remaining part of the piston between the apertures.

14. An apparatus according to claims 9, 10, 11, 12 or 13, characterized in that the vessel accommodates one positive electrode and another negative electrode which are separated by means of a semipermeable partition dividing the vessel into two chambers of which one chamber accommodating the negative electrode is designed for the preparation of finished drilling mud and the other chamber is designed for accumulating products of oxidation reactions formed as a result of passage of electric current through drilling mud.

15. An apparatus according to claims 9, 10, 11, 12 or 13, characterized in that there is provided a direct current source having its negative terminal connected to at least one piston and the positive terminal connected to a wall of the vessel through which extends the rod of this piston at least one semipermeable partition being provided adjacent to this wall to define with the wall a chamber for accumulating products of oxidation reactions formed upon passing electric current through drilling mud, the partition being made of a material hindering the penetration of products of oxidation reactions to the remaining part of the vessel.

* * * * *